US008002583B2

(12) United States Patent
van Woensel

(10) Patent No.: US 8,002,583 B2
(45) Date of Patent: Aug. 23, 2011

(54) ELECTRICAL CONNECTOR SYSTEM HAVING ELECTROMAGNETIC INTERFERENCE SHIELD AND LATCHING FEATURES

(75) Inventor: Johannes Maria Blasius van Woensel, Rosmalen (NL)

(73) Assignee: FCI, Guyancourt (FR)

( * ) Notice: Subject to any disclaimer, the term of this patent is extended or adjusted under 35 U.S.C. 154(b) by 120 days.

(21) Appl. No.: 12/388,097

(22) Filed: Feb. 18, 2009

(65) Prior Publication Data

US 2009/0233485 A1 Sep. 17, 2009

Related U.S. Application Data

(60) Provisional application No. 61/036,795, filed on Mar. 14, 2008.

(51) Int. Cl.
*H01R 13/648* (2006.01)

(52) U.S. Cl. ..... 439/607.56; 439/607.27

(58) Field of Classification Search ..... 439/607.27, 439/607.56

See application file for complete search history.

(56) References Cited

U.S. PATENT DOCUMENTS 5,836,774 A * 11/1998 Tan et al. ..... 439/76.1
5,879,173 A 3/1999 Poplawski et al.
6,095,862 A 8/2000 Doye et al.
6,159,022 A * 12/2000 Tsai ..... 439/76.1
6,179,627 B1 * 1/2001 Daly et al. ..... 439/76.1
6,524,134 B2 * 2/2003 Flickinger et al. ..... 439/607.2
6,869,308 B2 * 3/2005 Wu ..... 439/497
7,090,509 B1 * 8/2006 Gilliland et al. ..... 439/76.1
7,651,341 B2 * 1/2010 Wu ..... 439/76.1
2002/0004321 A1 * 1/2002 Anzai et al. ..... 439/76.1
2009/0233485 A1 * 9/2009 van Woensel ..... 439/607.34

OTHER PUBLICATIONS

Product Datasheets, 10 Gbit/s XENPAK 850 nm Transponder (TRP10GVP2045), Copyright 2005, MergeOptics GmbH, 13 pages.
Product Datasheets, Welome to XENPAK.org, Copyright 2001, http://www.xenpak.org, 1 page.

* cited by examiner

*Primary Examiner* — James Harvey
(74) *Attorney, Agent, or Firm* — Woodcock Washburn LLP

(57) ABSTRACT

A connector system may facilitate interconnection between electrical components, such as a printed circuit board and a cable. The connector system may reduce the effect of electromagnetic interference on the transfer of power and data signals between the cable and the printed circuit board. The connector systems may include a cable connector assembly and an electromagnetic shield. The electromagnetic shield may include a body that is configured to receive the connector assembly, thus, providing a shielded channel into which the connector assembly may be inserted. The connector system may includes latches that facilitate having multiple connectors adjacent to one another in close proximity. The cable assembly include pivotally supported latches with vertically staggered handles such that when a pair of connector systems are mounted laterally side-by-side, the adjacent handles can pivot without interfering with each other.

19 Claims, 12 Drawing Sheets

ELECTRICAL CONNECTOR SYSTEM HAVING ELECTROMAGNETIC INTERFERENCE SHIELD AND LATCHING FEATURES

CROSS REFERENCE TO RELATED APPLICATIONS

This application claims the benefit of U.S. provisional patent application Ser. No. 61/036,795 filed on Mar. 14, 2008, the disclosure of which is hereby incorporated by reference as if set forth in its entirety herein.

BACKGROUND

The present disclosure generally relates to electrical connectors, and in particular to electrical connectors having electromagnetic interference shielding and latching features.

An electronic system, such as a computing device for example, may include components mounted on printed circuit boards that are housed in a chassis, such as an enclosure for example. The circuit boards may be connected to cables to transfer power and data signals inside and outside of the chassis. The size and shape of the chassis may be dictated by the external physical constraints of the application in which the electronic system is to be used. For example, a rack-mounted electronic system may have a chassis that conforms to one or more industry standard sizes. With regard to size, electronic system are becoming increasingly dense with more components being fit into smaller spaces. As a result, many features that once had ample space are becoming increasingly cramped, affecting usability for technicians using, servicing, installing, and removing equipment.

However, the size and shape of the circuit boards within the chassis may be dictated by electrical and physical design criteria, such as component placement, heat flow, space efficiency, signal integrity, electromagnetic interference, and the like. In some instances, electromagnetic interference may cause a disturbance of an electrical circuit that may degrade the circuit's performance. In some instances, some components in a chassis may cause electromagnetic interference with other components in the chassis.

SUMMARY

The connector system disclosed herein may include a tray, a connector assembly, a pivotally supported first latch member, and a pivotally supported second latch member. The tray may define a leading end and a trailing end opposite the leading end. The connector assembly may be disposed at the trailing end of the tray. The pivotally supported first latch member may be disposed at a first side of the connector assembly, and the pivotally supported second latch member may be disposed at a second side of the cable assembly that is at laterally opposed to the first side. The first and second latch members may include transversely staggered, respective handles.

The electromagnetic shield disclosed herein may include a first end portion, a second end portion, and a shield portion. The first end portion may be configured to receive a leading end of a connector assembly. The second end portion may be opposite the first end portion. The shield portion may extend from the first end portion in a first direction to the second end portion. The shield portion may be configured to at least partially shield the connector assembly when the connector assembly is inserted via the first end portion in the first direction.

Additional features and advantages of the invention will be made apparent from the following detailed description of illustrative embodiments that proceeds with reference to the accompanying drawings. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION OF ILLUSTRATIVE EMBODIMENTS

In general, the connector system disclosed herein may facilitate interconnection between electrical components, such as a printed circuit board and a cable, for example. The connector system may reduce the effect of electromagnetic interference on the transfer of power and data signals between the cable and the printed circuit board. Moreover, the connector system may includes latches that facilitate usability, especially when multiple connectors are adjacent to one another in close proximity.

Figure 1:
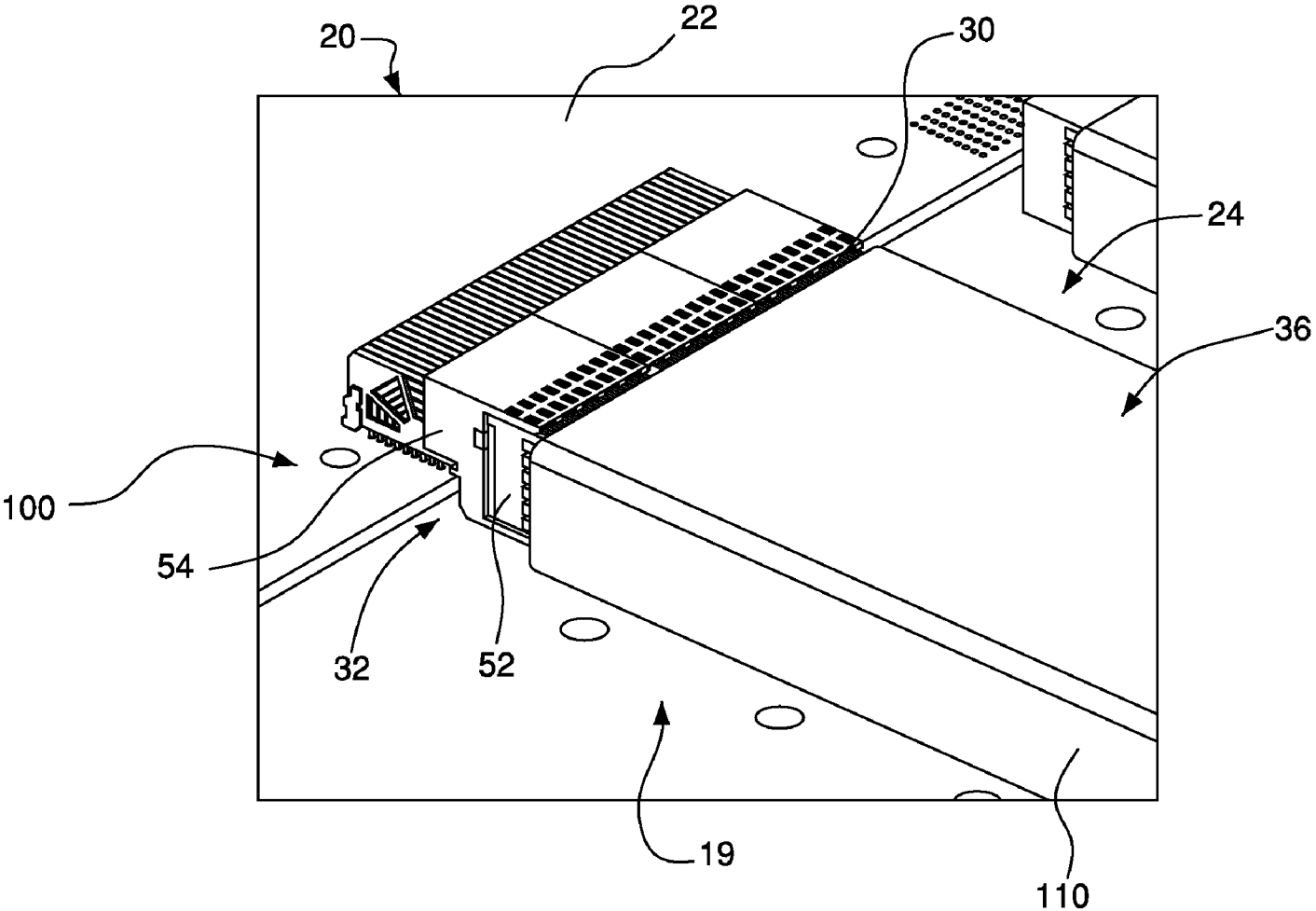
FIG. 1 is a perspective view of a first portion of an I/O communications system including a connector system including a connector tray attached at one end to a printed circuit board.
Figure 2:
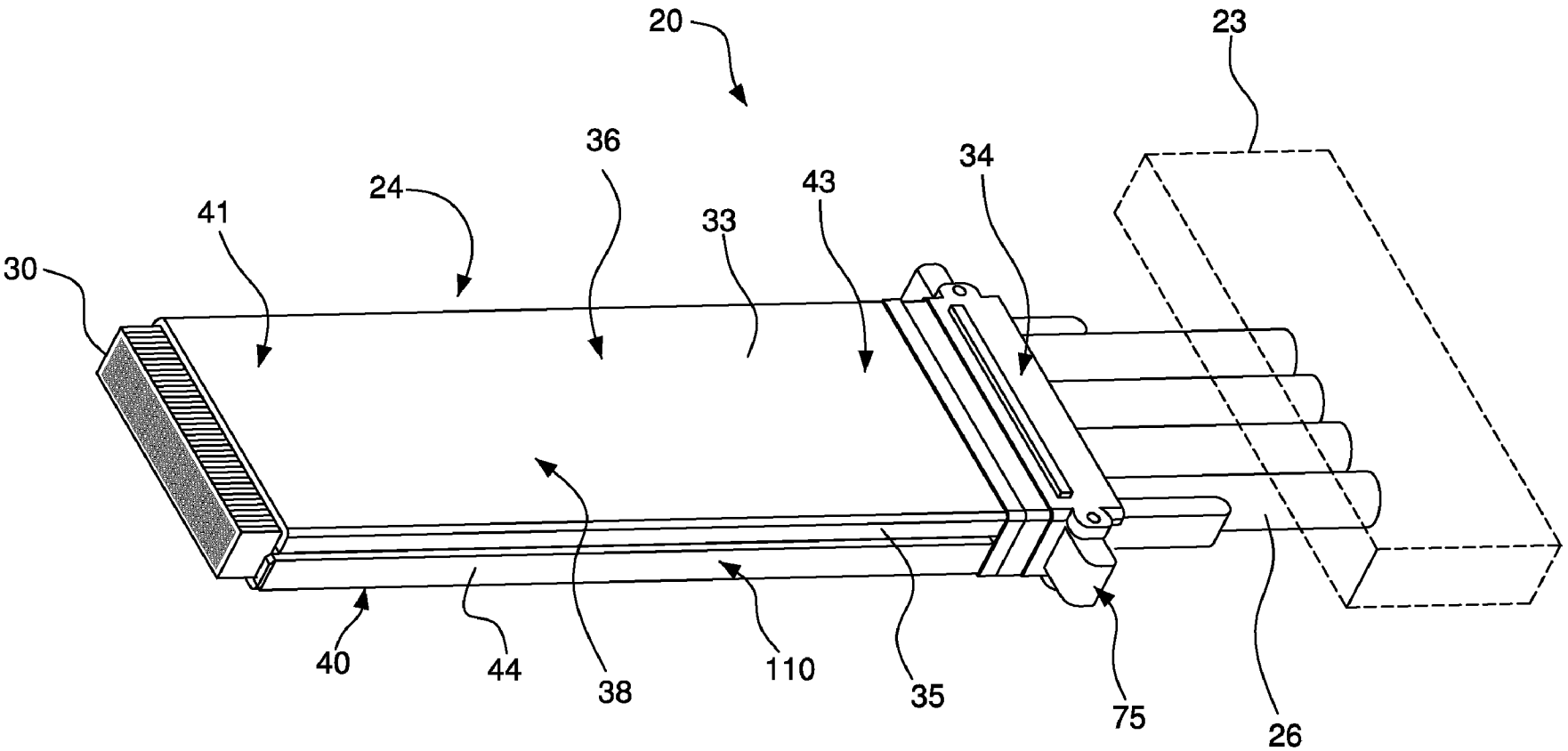
FIG. 2 is a perspective view of a second portion of the communications system illustrated in FIG. 1, showing the connector tray further attached to an I/O device via a set of I/O cables.

Referring to FIGS. 1-2, an I/O (input/output) communications system 20 can include an electrical component, such as a printed circuit board 22 within a chassis 19 (such as an enclosure, for example), an electrical device, such as an I/O device 23, and a connector system 24 that facilitates communication between the circuit board 22 and the external electrical device 23. Electrical signals can be communicated between the connector system 24 and external electronic device 23 by one or more signal conduits 26. In one embodiment, the signal conduit 26 can be provided as one or more I/O cables.

Figure 8:
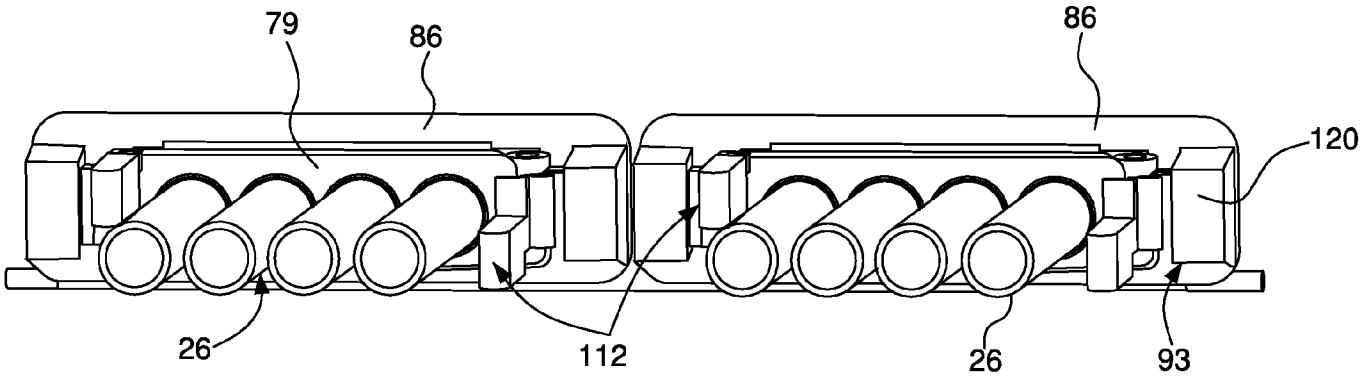
FIG. 8 is an end perspective view of a pair of side-by-side connector systems including staggered connector latches.

It should be appreciated that the I/O communications system 20 can include one or more connector systems 24 attached between the printed circuit board 22 and an electrical device, such as device 23. Alternatively still, a plurality of connector systems 24 can be connected between the circuit board 22 and more than one electrical device such as device 23. For instance, FIG. 8 illustrates two connector systems 24 disposed in a side-by-side relationship.

The I/O connector system 24 can include a plurality of electrical connector assemblies 30 (see FIG. 1), 32 (see FIG. 1), and 34 (see FIG. 2) that can electrically connect the circuit board 22 and the signal conduit 26. For instance, a first electrical connector assembly 30 may provide a electrical connection to I/O connector system 24. A complementary, second electrical connector 32 may provide an electrical connection to the circuit board 22. The first and second electrical connector assemblies 30, 32 may mate to provide an electrical connection between the circuit board 22 and the I/O connector system 24. A third electrical connector assembly 34 can electrically connect the I/O connector system 24 to the signal conduit 26, thus providing an electrical connection from the circuit board 22 to the signal conduit 26 via the I/O connector system. Each electrical connector assembly will now be described.

Figure 3A:
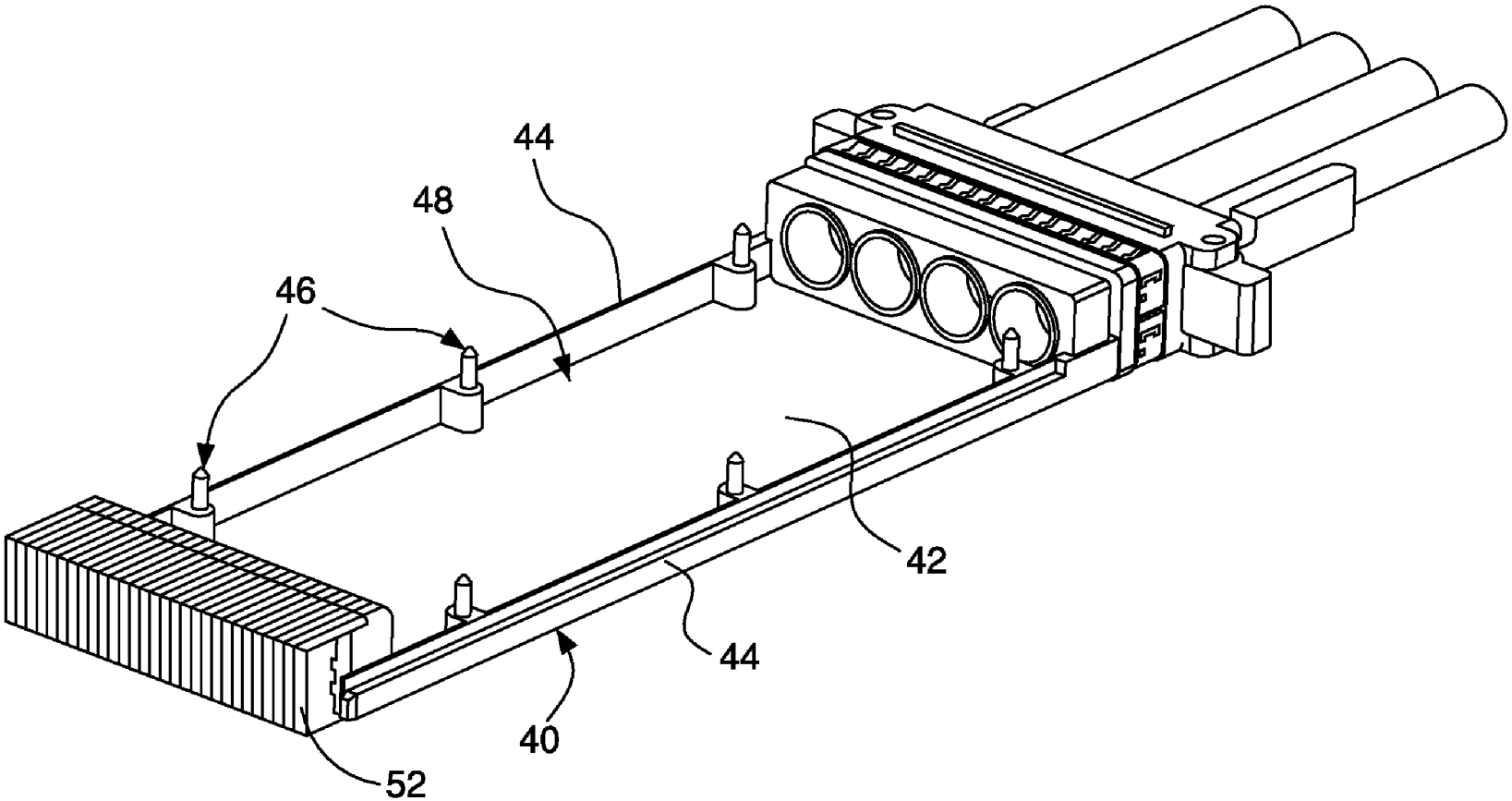
FIG. 3A is a perspective view showing the tray illustrated in FIG. 1, with a portion of the connector tray removed.

Referring now to FIGS. 2-3A, the first electrical connector assembly 30 can include a connector member in the form of a longitudinally elongate connector tray 36. The connector tray 36 can include an upper cover 38 and bottom cover 40. The bottom cover 40 includes a base 42 and a pair opposing side walls 44 extending up from the base 42. The upper cover 38 includes an upper surface 33 and a pair of opposing side walls 35 that engage the side walls 44 when the covers 38 and 40 are connected.

The upper and bottom covers 38 and 40 can include any suitable engagement member that can mate when connecting the covers 38 and 40. As illustrated, a plurality of engagement members 46 in the form of posts can extend up from the base 42 at a location adjacent to the side walls 44. The engagement members 46 can be configured to be received in, and press-fit into if desired, complementary apertures (not shown) formed in the upper cover 38. Of course, the positions of the posts 46 and apertures could be reversed such that the posts 46 extend down from the upper cover 38 and complementary apertures 47 (see FIG. 13) are formed in the bottom cover 40. The reversal of mating engagement members is generally applicable throughout this disclosure unless otherwise specified. Furthermore, while examples of engagement members are provided, any suitable mechanical engagement members are contemplated. The connector tray 36 defines a first board interfacing end 41 (e.g., a leading end) and an opposing second I/O carrier interfacing end 43 (e.g., a trailing end), and can be secured between the circuit board 22 and the signal conduit 26 by the second and third connector assemblies 30 and 34.

Figure 13:
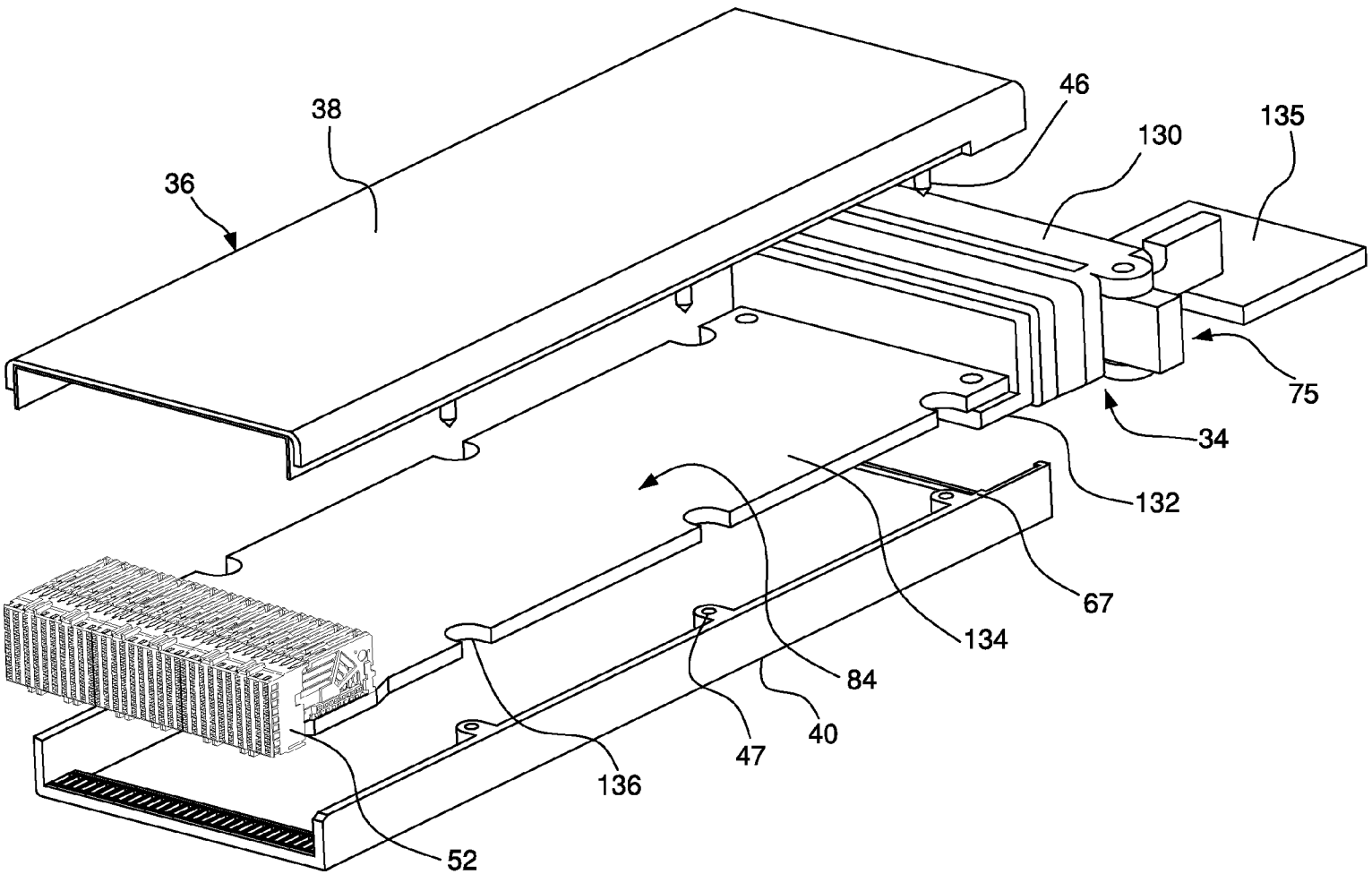
FIG. 13 is an exploded assembly view of the connector tray illustrated in FIG. 12.

As shown in FIG. 3A, the connector tray 36 can carry a plurality of electrical traces 48 that can extend between the leading end 41 and the trailing end 43 of the tray 36. The electrical connector 52 may be a right angle connector suitable to provide an electrical connection to the traces 48. Similarly, an right-angle electrical connector, such as the right-angle electrical connector 132 as shown in FIG. 13 for example, may provide an electrical connection to the traces 48, thus providing an electrical connection from the electrical connector 52 to the signal conduit 26.

The electrical traces 48 may define an I/O card that provides an interface for the I/O signals that are communicated between a printed circuit board 22 and the external I/O device 23. In one embodiment, the traces 48 can extend along the upper surface of the base 42 between the leading and trailing ends 41 and 43. Alternatively, the traces 48 can comprise one or more embedded layers disposed in the base 42 between the upper and bottom surfaces of the base 42. Alternatively still, or in addition, the traces 48 can by carried by the upper cover 38 in any manner described above with respect to the lower cover 40. Alternatively still, the tray 36 can retain or otherwise support a discrete circuit board 134, as described below with reference to the alternative embodiment illustrated in FIGS. 12-13.

Figures 3B, 4:
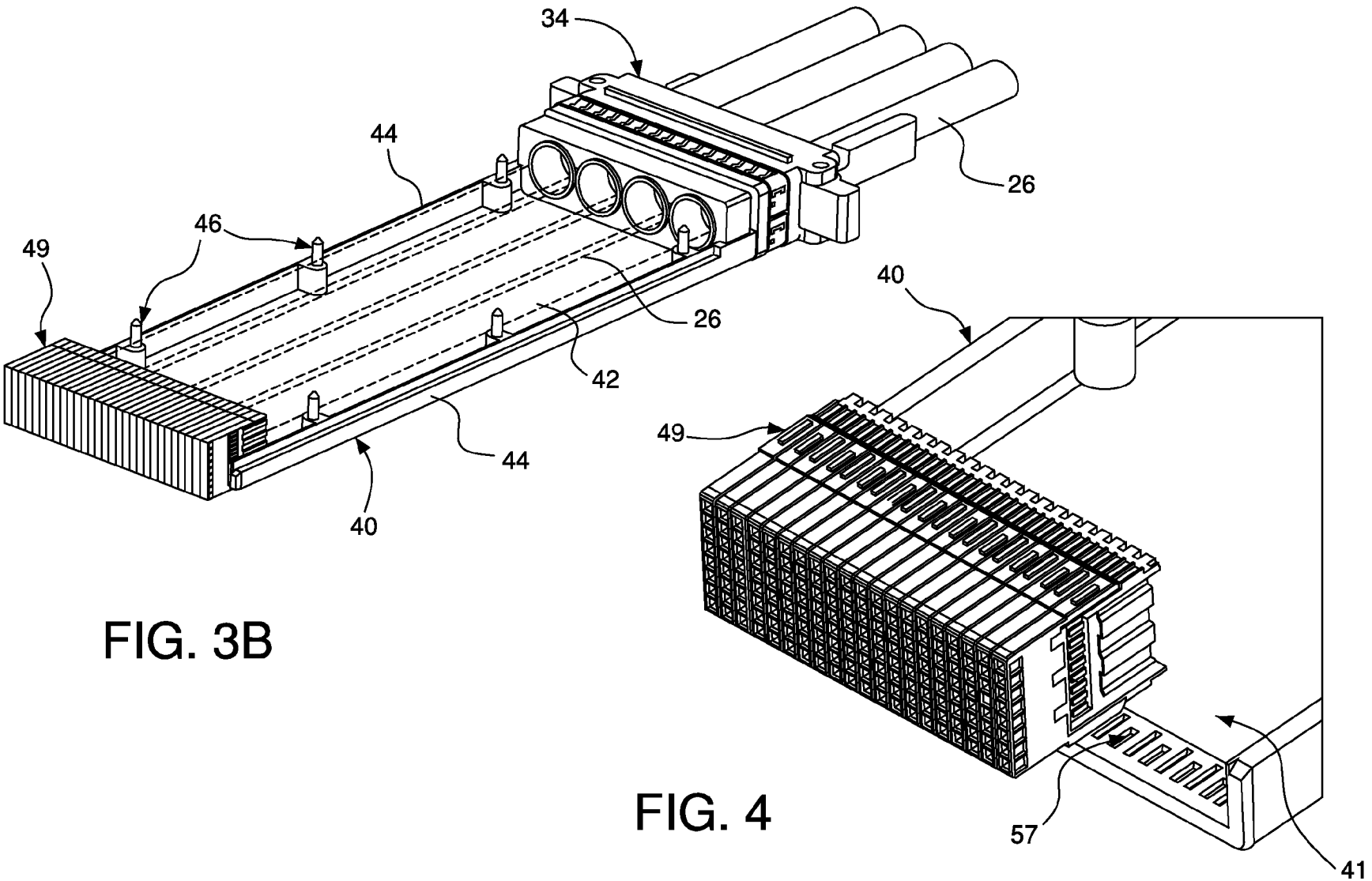
FIG. 3B is a perspective view similar to FIG. 3A, showing the connector tray constructed in accordance with an alternative embodiment.
FIG. 4 is an enlarged perspective view of a board-interfacing end of the connector tray illustrated in FIG. 3B with a portion removed to illustrate connector-retaining members carried by the connector tray.

In an alternative embodiment illustrated in FIG. 3B, the signal conduits 26 can extend through connector assembly 34 and terminate with an I/O connector that attaches to a rear end of first connectors 49. Of course, the alternative connectors shown in FIGS. 3A & 3B are examples. One skilled in the art appreciates that such connectors are readily interchangeable to suit a design requirements.

In all of the above embodiments, the tray 36 can be said to "carry" or "support" electrical traces either directly on the tray itself or indirectly via a circuit board, daughtercard (i.e., electrical traces of a circuit board, daughtercard, or the like), or directly wired from the signal conduits 26 to the rear end of the first connector 49, as shown in FIG. 3B.

Referring to FIGS. 1, 3A, and 4, the second connector assembly 32 can electrically connect the electrical traces 48 or internal cabling carried by the connector tray 36 to complementary electrical traces of the circuit board 22. While any suitable board-to-board connector assembly capable of connecting electrical traces of a pair of circuit boards could be used, the illustrated embodiment includes a first and second connector 52 and 54, respectively. Specifically, the first connector 52 can be dedicated to the connector tray 36, while the second connector 54 can be dedicated to the circuit board 22 in the illustrated embodiment.

Figure 5:
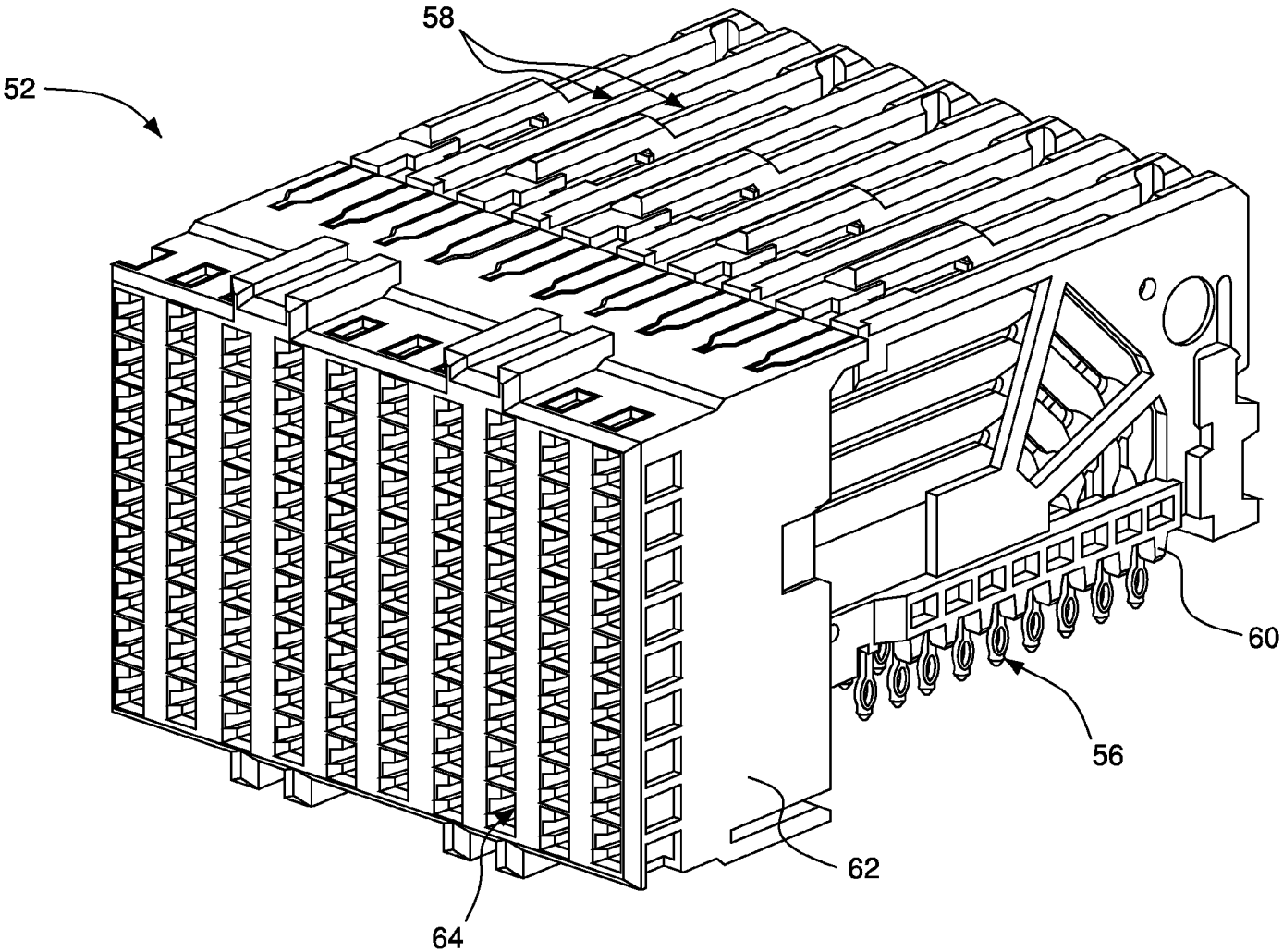
FIG. 5 is a perspective view of an electrical connector that can be included in the I/O communications system illustrated in FIG. 1.

Referring to FIG. 5 in particular, the first connector 52 can include a plurality of electrically conductive contacts 56 disposed in an array of insert molded lead assemblies (IMLAs) 58. When mounted onto the connector tray 36 or circuit board 22, the contacts 56 are electrically connected to the conductive traces 48 carried by the connector tray 36. The contacts 56 can be press-fit or surface mounted, or the contacts can be through-mounted and soldered onto the bottom surface of the connector tray base 42. According to an aspect of the invention, an IMLA 58 can be used for single-ended signaling, differential signaling, or a combination of single-ended signaling and differential signaling. The electrically conductive contacts 56 can extend through a lead frame 60, which can be made of a dielectric material such as a plastic that can be over-molded on to the contacts 56. The first connector 52 further includes a housing 62 that defines a plurality of receptacles 64 configured to receive complementary header contacts that electrically connect to the electrically conductive contacts 56. A plurality of connector-retaining members can be provided in the form of longitudinally elongate grooves 57 (see FIG. 4) of varying lengths that extend into the base 42 of the tray 36 at the board-interfacing end 41. The grooves 57 can be configured to receive corresponding engagement members (not shown) extending down from the first connector 52 to further secure the connector 52 to the tray 36.

Referring to FIGS. 3B and 4, electrical connector 49 can be right angle, vertical, or any other appropriate style I/O receptacle connectors, such as those commercially available under the AIRMAX brand.

Figure 6:
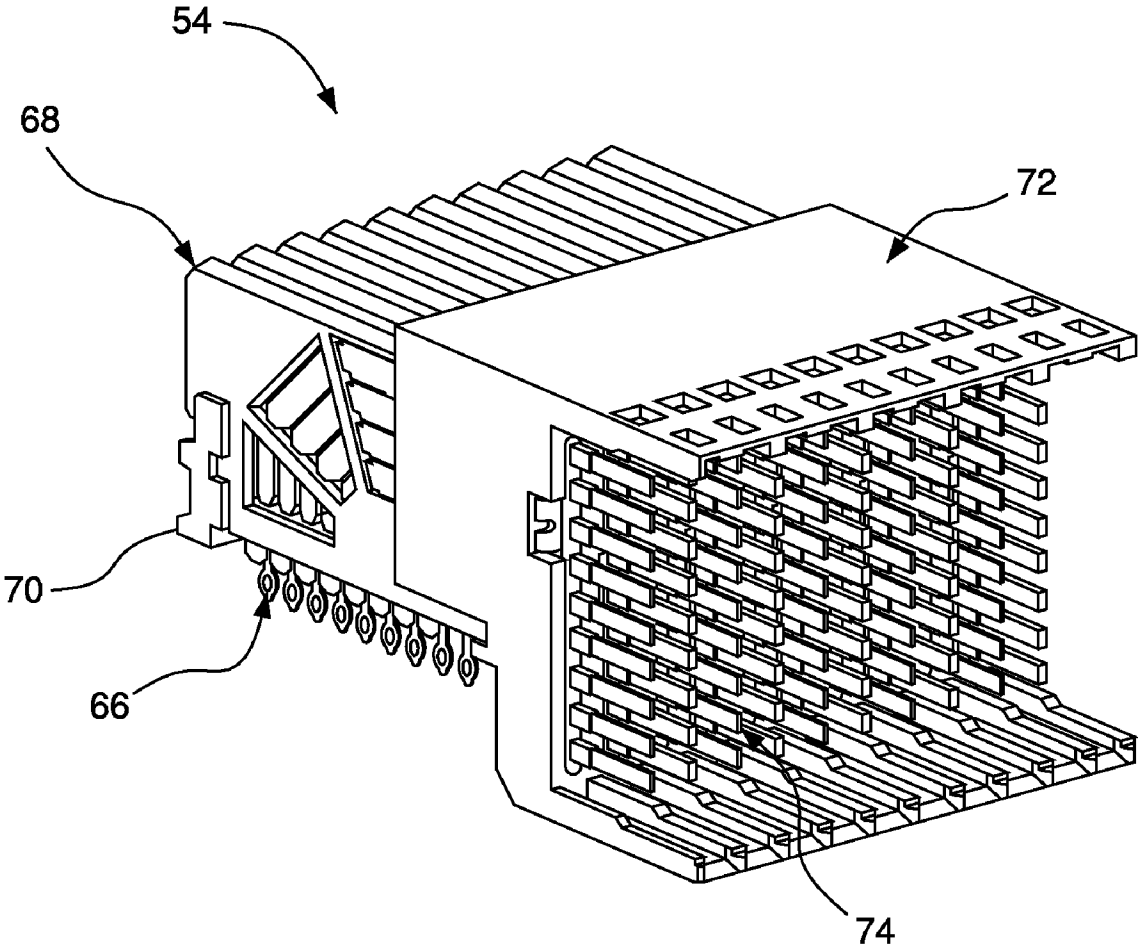
FIG. 6 is a perspective view of an electrical connector that can be included in the I/O communications system illustrated in FIG. 1.

Referring to FIG. 6, the second connector 54 can likewise include a plurality of electrically conductive contacts 66 disposed in an array of insert molded lead assemblies (IMLAs) 68. When mounted onto the connector tray 36, the contacts 66 are electrically connected to the conductive traces carried by the circuit board 22. Specifically, the contacts 66 can be press-fit or surface mounted. Alternatively, if desired, the contacts 66 can be through-mounted and soldered onto the bottom surface of the circuit board 22. According to an aspect of the invention, an IMLA 68 can be used for single-ended signaling, differential signaling, or a combination of single-ended signaling and differential signaling. The electrically conductive contacts 66 can extend through a lead frame 70, which can be made of a dielectric material such as a plastic. The second connector 54 further includes a housing 72 that receives a plurality of header contact ends 74 configured for reception into the complementary receptacles 64 of the first connector 52 to electrically connect the circuit board 22 to the electrical traces 48 carried by the connector tray 36. A plurality of longitudinally elongate grooves (not shown) similar to grooves 57 can extend into the circuit board 22 to receive corresponding engagement members (not shown) extending down from the second connector 54 to secure the connector 54 to the circuit board 22.

Connectors 52 and 54 can be constructed and operate as described in U.S. Pat. No. 7,331,800, the disclosure of which is hereby incorporated by reference as if set forth in its entirety herein. It should be appreciated that while the second connector assembly 32 includes connectors 52 and 54 as right angle connectors in the illustrated embodiment, any connector or connectors suitable for electronically connecting electrical traces of the circuit board 22 to traces 48 carried by the connector tray 36 (for instance a co-planar connector) could be used. It should be further appreciated that the number of electrically conductive contacts 56 and 66 of the connectors 52 and 54, respectively, can vary depending on the desired application.

Figure 7:
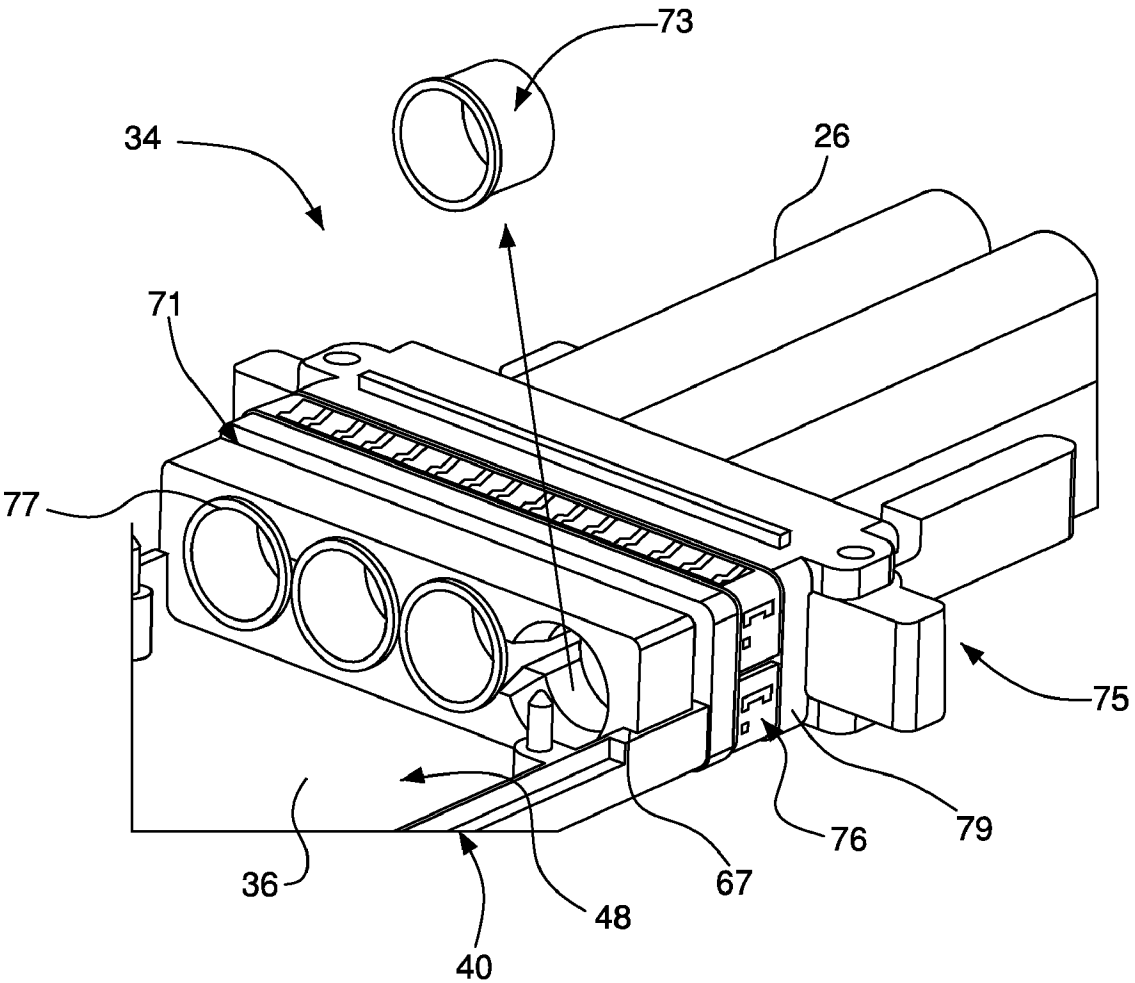
FIG. 7 is an enlarged perspective view of an I/O carrier interfacing end of the connector tray illustrated in FIG. 2 with portions removed.
Figure 9:
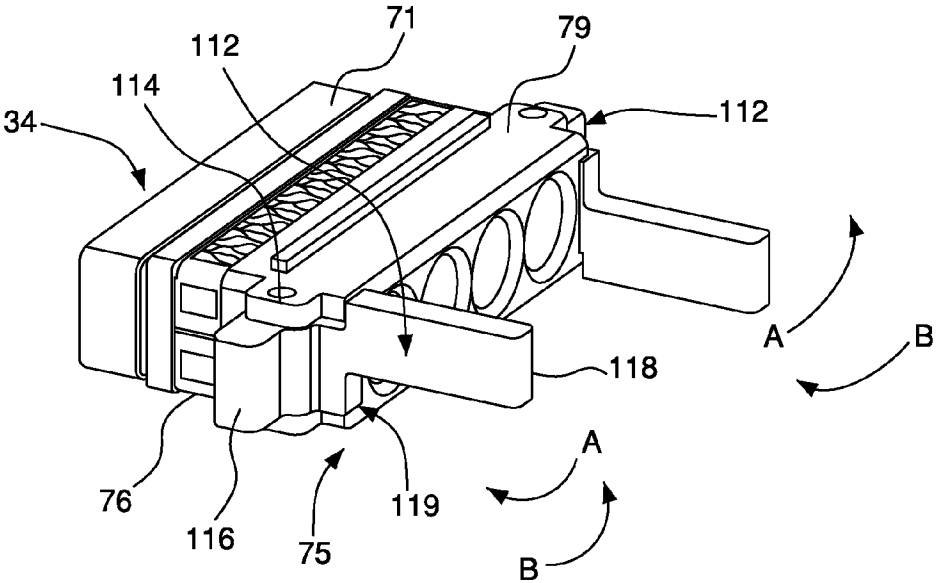
FIG. 9 is a perspective view of one of the connector systems illustrated in FIG. 8.

Referring now also to FIGS. 7-9, the third electrical connector assembly 34 electrically connects the signal conduits 26 to the electrical traces 48 carried by the connector tray 36. In the instance where the signal conduits 26 comprise a plurality of cables, the third connector assembly 34 can include a cable retention housing 79 that defines a plurality of laterally spaced openings 77, each configured to receive a cable. The cable retention housing 79 can be removably secured to the remainder of the connector system 24 via a latch assembly 75, as is described in more detail below. Similarly, the connector system 24 may be removably secured to a shield 80 (see FIGS. 10 & 11) via latch assembly 75. The shield 80 may provide electromagnetic shielding when the connector tray 36 is inserted into the shield 80.

As best shown in FIG. 7, the third connector assembly further includes a ferrule housing 71 that defines a plurality of laterally spaced openings 77 extending longitudinally through the housing 71 that can each accept one of the cables. The ferrule housing 71 can be retained in a groove 67 formed in the side walls 44 of the bottom cover 40 at the I/O carrier interfacing end 43. A similar groove aligned with the groove 67 of the bottom cover 40 can be formed in the upper cover 38 to further secure the ferrule housing 71.

The ferrule openings 77 can each receive a ferrule 73 that is configured to retain one of the cables and terminate the electrically conductive braids disposed in each cable. The ferrule housing 71 and ferrules 73 thus provide an interface between the signal conduit 26 and any suitable cable-to-board connector (not shown) that can include electrical contacts that can plug into the ferrules at one end and attach to the cable braid, and can couple to the electrical traces carried by the connector tray 36 at another end. One example of a cable-to-board connector is described in more detail below with reference to a connector 132 illustrated in FIG. 13 that can be modified for installation into the third connector assembly 34 illustrated in FIG. 7. It should further be appreciated that the third connector assembly 34 has been described in accordance with one embodiment, and that any connector assembly capable of electrically connecting the signal conduit 26 to the electrical contacts 48 of the connector tray 36 is contemplated by the present invention.

When both housings 71 and 79 are installed in the connector system 24, the apertures 78 extending through housing 79 can be aligned with the ferrules 73 so that the cables (or cable braids) extend through the housing 79 and into the ferrules 73. An electrically conductive electromagnetic (EMC) shielding spring 76 can surround the interface between the housings 77 and 79 to protect the adjacent signal conduits from interference, or cross talk.

Figure 10:
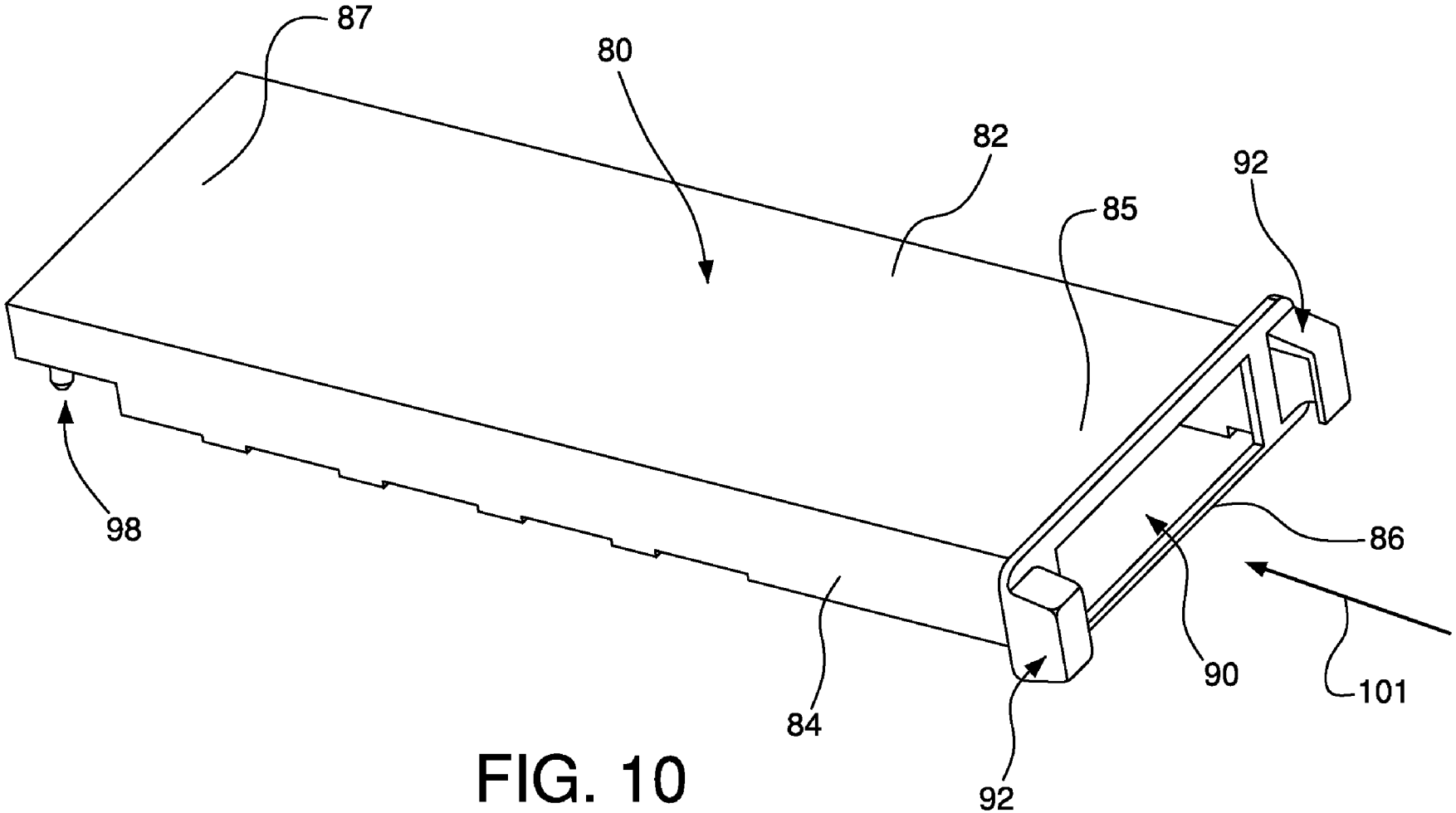
FIG. 10 is a top perspective view of an electromagnetic shield that forms part of the connector assembly illustrated in FIG. 1.
Figure 11:
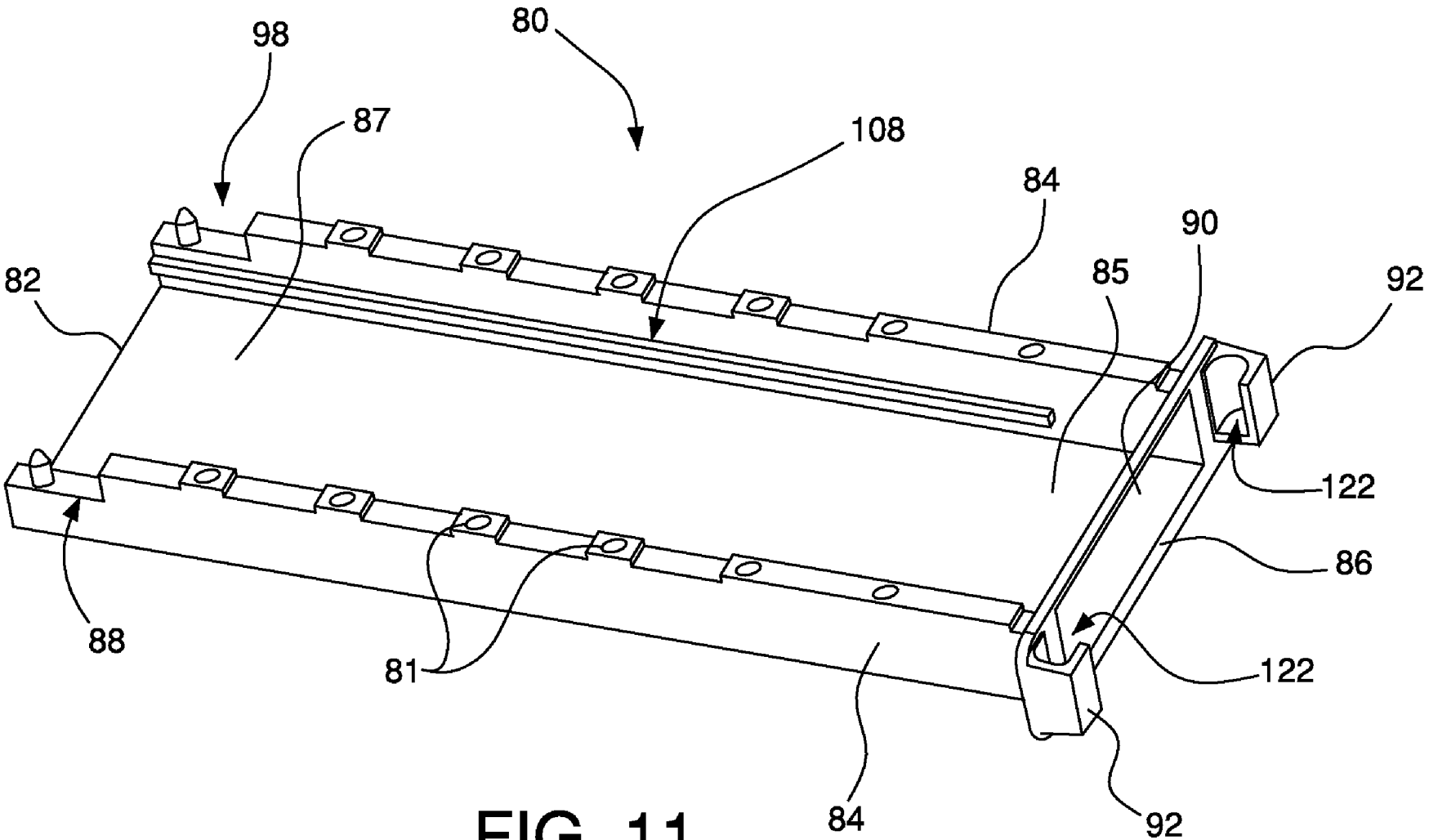
FIG. 11 is a bottom perspective view of the electromagnetic shield illustrated in FIG. 10.

Referring now to FIGS. 10-11, certain embodiments recognize the desirability of providing a shield that protects other electrical components disposed in close proximity of the connector tray 36 from electromagnetic interference that could result from electrical signals passing through the electrical traces 48 carried by the connector tray 36. Accordingly, the second connector assembly 32 can include an electromagnetic shield 80 that is longitudinally elongate to correspond with the shape of the connector tray.

The electromagnetic shield 80 can be provided as a die cast metallic (i.e., electrically conductive) bezel body that defines an upper wall 82, a pair of side walls 84 that extend downwardly from the laterally opposing ends of the upper wall 82, and an end wall 86 connected between the side walls 84 at one longitudinal end 85 of the shield 80. A pair of notches or cut-outs 88 can be formed in the side walls 84 that are configured to receive the circuit board 22 when the shield 80 is connected to the connector tray 36 at the opposing longitudinal end 87.

The electromagnetic shield 80 can further include an engagement member 98 configured to mate with a corresponding engagement member 100 carried by the circuit board 22 to attach the shield 80 to the circuit board 22 in a desired position and orientation. As illustrated, two laterally spaced engagement members 98 are carried by the shield 80 at the notches 88 that mate with two complementary engagement members 100 on the circuit board 22.

Each engagement member 98 can be provided in the form of a positioning peg that protrudes down from the notched portion of each side wall 84. Each engagement member 100 can be provided in the form of an aperture extending into the circuit board 22. The apertures 100 can be sized to receive the positioning pegs 98 either loosely or in a press-fit connection if desired. The engagement of the positioning members 98 and 100 on the circuit board 22 to locate the shield 80 on the circuit board 22 and provide mechanical support to the attachment of the connector tray 36 to the circuit board 22. The shield may include one or more engagement members 83, such as screw holes for example, to mount the shield to a chassis 19, such as an enclosure. The chassis 19 may include complementary engagement members (not shown).

An aperture 90 can extend through end wall 86 of the shield 80 that is sized to receive the connector tray 36, and is further sized to receive a portion of the third connector assembly 34. The aperture 90 may be configured to receive the leading end 41 of the connector tray 36 in a first direction 101. A pair cam of retention members 92 can be carried or otherwise supported by the end wall 86. Each retention member 92 is configured to assist in attaching the cable retention housing 79 to the connector system 24, and facilitating removal of the cable attention housing 79 from the connector system 24. Each retention member 92 is configured to assist in attaching the connector system 24 to shield 80, and facilitating removal of the connector system 24 from the shield.

With further reference to FIGS. 10 & 11, the shield 80 further includes a pair of guide members 108 which can be provided in the form of a guide bar protruding in from each side wall 84 and extending longitudinally along the side wall 84 between the opposing longitudinal ends of the shield 80. The guide bars 108 can be sized to be received in a corresponding guide member 110 that can be provided as a groove extending into the outer surface of the side walls of the connector tray 36. The groove 110 can be formed in the side wall 35 of the upper cover 38 or the side wall 44 bottom cover 40. Alternatively, a portion of the groove 110 can be defined by both side walls of both covers 38 and 40, such that the groove 110 is defined when the covers 38 and 40 are connected. The groove 110 can be disposed at a location off-center with respect to the vertical distance between the upper and bottom covers 38 and 40, and the guide bars 108 can likewise be disposed at a location off-center with respect to the vertical distance between the end of side walls 84 and the upper wall.

Accordingly, the connector system 24 can be assembled by inserting the connector tray 36 through the aperture 90 of the shield such that the grooves 110 of the connector tray 36 receive the complementary guide bars 108 of the shield 80. The off-center locations of the grooves and guide bars ensure that the tray 36 is inserted in the desired orientation so that the guide bars 108 register with the grooves 110. The side walls 84 and upper wall 82 of the shield 80 can thus substantially or entirely surround the upper tray surface 33 and side walls 35 and 44, and thereby providing substantially 270° of electromagnetic protection to the electrical traces 48 carried by the connector tray 36. Alternatively, the shield 80 could further surround the base 42 of the bottom cover 40. Prior to insertion of the tray 36 into the shield 80, the first electrical connector 52 can be pre-fastened to the connector tray 36, and the second electrical connector can be pre-fastened to the circuit board 22. Accordingly, first connector 52 attaches to the second connector 54 once the tray 36 has been fully inserted into the shield 80.

The electromagnetic shield may be mounted to the chassis, thus providing a shielded channel into which the connector assembly may be inserted. The chassis may include a enclosure, such as a computer enclosure. Accordingly, operation of I/O connector 24 and shield 80 may include mounting an electromagnetic shield to a chassis. The electromagnetic shield may include a first end portion 85, a second end portion 87, and a shield portion (e.g., the upper wall 82 and side walls 84 of the shield 80). The first end portion may be configured to receive a leading end of a connector assembly, such as the first board interfacing ed 41 of I/O connector 24, for example. The second end portion 87 may be opposite the first end portion 85. The shield portion may extends from the first end portion 85 in a first direction 101 to the second end portion 87. Operation of I/O connector 24 and the shield 80 may further include inserting the I/O connector 24 via the first end portion 85 in the first direction 101 until the leading end of the I/O connector 24 is proximate to the second end portion 87, such that the shield portion is at least partially shielding the I/O connector 24. For example, the I/O connector 24 may be inserted via the first end portion 85 in the first direction 101 until the first connector 52 mates with the second connector 54 (as shown in FIG. 1).

Various structure is described as extend in longitudinal direction, in a lateral direction, and in a transverse direction (i.e., vertical direction). Unless otherwise specified herein, the terms "lateral," "longitudinal," and "transverse" as used to describe the orthogonal directional components of various components. It should be appreciated that while the longitudinal and lateral directions are illustrated as extending along a horizontal plane, and that the transverse direction is illustrated as extending along a vertical plane, the planes that encompass the various directions may differ during use, depending, for instance, on the orientation of the various components. Accordingly, the directional terms "vertical" and "horizontal" are used to describe the components as illustrated merely for the purposes of clarity and convenience, it being appreciated that these orientations may change during use.

The third connector assembly 34 can be further installed such that the signal conduit 26 can be electrically connected to the conductive traces 48 carried by the connector tray 36. Specifically, referring now to FIGS. 2, 8, and 9, the latching system 75 can include a pair of latch members 112 that each in turn includes a cam member 116 and a handle 118 that extends in a fixed direction angularly offset with respect to (and perpendicular to, as illustrated) the cam member 116. Accordingly, when the cam member 116 extends in a lateral direction, the handle 118 extends in a longitudinal direction. An elbow 119 joins the handle 118 and cam member 116.

Each latch member 112 can be pivotally attached to laterally opposing ends of the cable retention housing 79 via a hinge, or pin 114, that extends vertically through a pair of vertically spaced protrusions that extends laterally out from the housing 79. Each pin 114 extends through a corresponding aperture (not shown) extending through each the elbow 119 of each latch member 112.

Each cam retention member 92 can include a cam retention housing 120 that protrudes longitudinally out from the laterally outer ends of the end wall 86. The end wall 86 may define first and second cam retention pockets 112. For example, the cam retention pockets 122 may extend laterally into the retention housing 120. Each cam member 116 is sized to fit within the cam retention member 92 that is supported by the end wall 86 of the electromagnetic shield 80.

The cable retention housing 79 can thus removably attached to the connector system 24. Similarly, the connector system 24 may be removable attached to the shield 80. Pivoting the handles 118 outward along the direction of Arrow A decreases the distance between the opposing cam members 116 until it becomes less than the distance between retention housings 120. The cable retention housing 79 is then inserted until the handles 118 can be pivoted inward along the direction of Arrow B to cause the cam members 116 to fit within the corresponding recesses 112. Each handle 118 can then be pivoted further inward to the position illustrated in FIG. 8 to secure the housing 79 to the end wall 86. The cable retention housing 79 can be removed from the end wall 86 by again pivoting the handles outward, causing the cam member 116 to cam along the end wall 86 within the pocket 122, which pushes the cable retention housing 79 away from the end wall 86 until the cam member 116 is removed from the pocket 122, whereby cable retention housing 79 can be removed.

As best shown in FIG. 8, when a pair of connector systems 24 are mounted in a side-by-side manner, the adjacent handles 118 of the side-by-side connector systems 24 can be attached to the corresponding elbow 119 in a transverse (e.g., vertically) staggered relationship. Accordingly, the upper and lower ends of one adjacent handle 118 can be disposed below the upper and lower ends of the other adjacent handle 118. In one example, the upper end of one adjacent handle can be disposed below the lower end of the other adjacent handle such that both handles can be pivoted outwards and pass by each other without interfering with each other.

Figure 12:
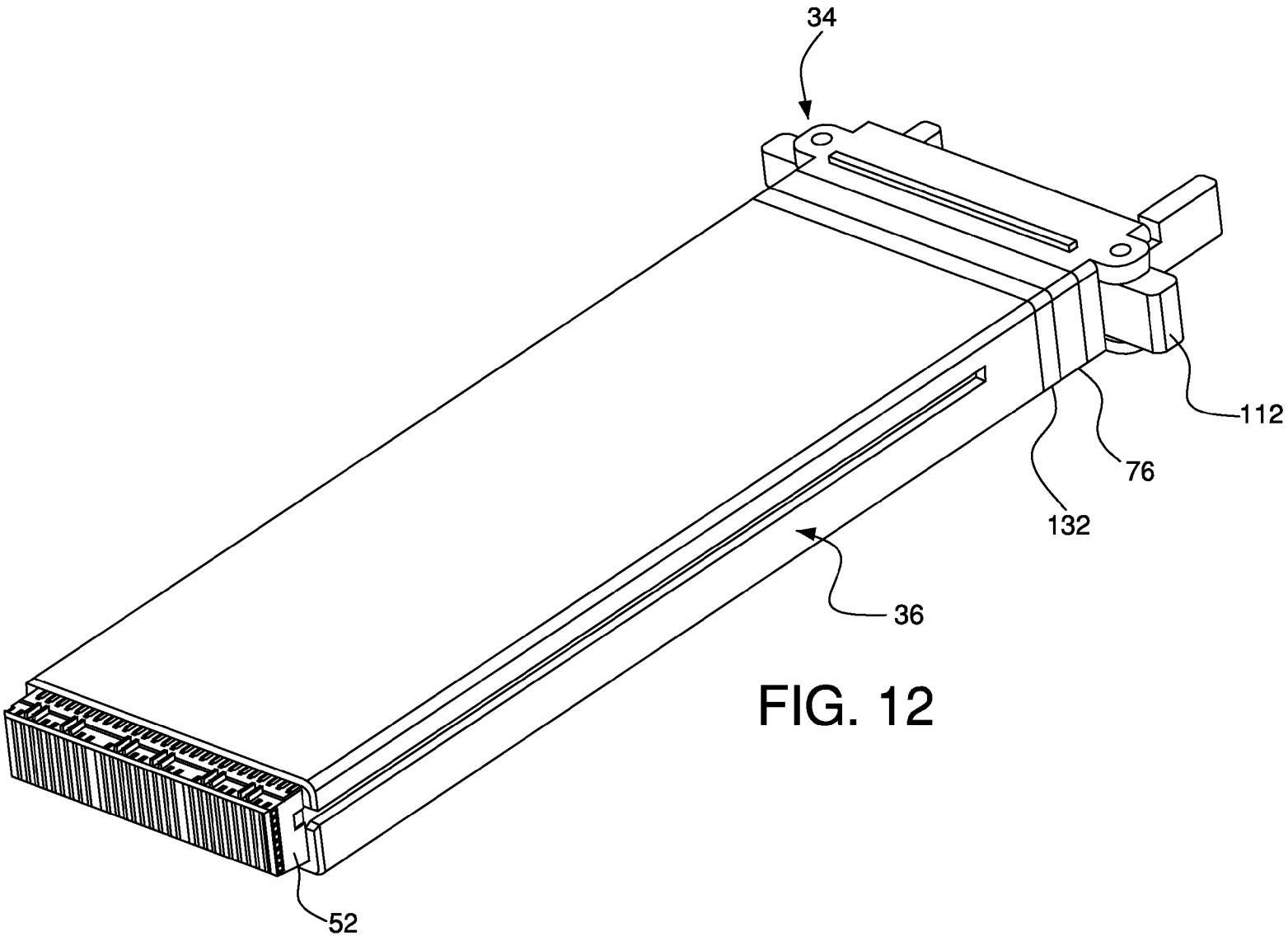
FIG. 12 is a perspective view of a connector tray constructed in accordance with an alternative embodiment.

Referring now to FIGS. 12-13, certain aspects of the present invention recognize that external I/O devices need not be connected to the third connector assembly 34 by a set of cables, and that the signal conduit 26 can be in the form of any suitable electrical conduit. For instance, a printed circuit board 135 can be connected between the third connector assembly 34 and the external I/O device 23. As a result, the cable retention housing 79 can be replaced with a connector 130 having electrical contacts (not shown) configured to attach to complementary traces on the circuit board 135. The ferrule housing 71 can be replaced by a second right angle connector 132 having electrical contacts (not shown) that attach to the contacts of the connector 130 at one end, and to the electrical traces 84 carried by the connector tray 36 at another end. Alternatively still, a co-planar connector or any alternative suitable electrical connector could be provided instead of the right angle connectors 130 and 132. Alternatively still, right angle connectors 130 and 132 could be provided as a single connector.

If the connectors 130 and 132 are provided as a single connector, and the signal conduits 26 extend through the ferrules 77 and connector tray 36 as described above with reference to FIG. 3B, then actuating the latch handles 118 can cause the third connector assembly 34 and the connector tray 36 to be inserted and removed together, as the housing 132 is retained in the tray 36 by the retention grooves 67.

Furthermore, certain embodiments further recognize that the electrical traces 84 need not be carried directly on or in one or more components of the connector tray 36. For instance, as illustrated in FIG. 13, the electrical traces 84 can be carried on a discrete printed circuit board 134 that can be retained within the connector tray 36. The circuit board 134, for instance, can be provided as an I/O. A plurality of round cut outs 136 can extend into the longitudinally extending edges of the circuit board 134. The cut outs 136 can be in alignment with the posts 46 extending down from the upper cover 38 and corresponding apertures 47 extending into the bottom cover 40 to locate the circuit board 134 inside the cover. The electrically conductive contacts 66 of the second connector 54 attach to complementary electrical traces 84 on the circuit board 134.

It should be appreciated that the connector tray 36 illustrated in FIGS. 12-13 can instead carry the electrical traces 84 in any manner described above. Likewise, the connector tray illustrated in FIG. 1 can carry the electrical traces on a discrete circuit board 134 as illustrated in FIG. 13. It should be further appreciated that the right angle connector 132 could also be used in combination with the ferrule housing 71 illustrated in FIG. 7, and can be modified to include a plug that is inserted into each ferrule 73 to bring the cables into electrical communication with the electrical traces 84. Furthermore, while the connector 132 is attached to the bottom surface of the circuit board 134 in FIG. 13, the connector 132 could alternatively attach to the upper surface of the base 42 of the bottom cover 40.

The embodiments described herein have been presented by way of illustration, and the present invention is therefore not intended to be limited to the disclosed embodiments. Accordingly, those skilled in the art will realize that the invention is intended to encompass all modifications and alternative arrangements included within the spirit and scope of the invention, as set forth by the appended claims.

What is claimed:

1. A communications system configured to connect a cable to an electrical connector mounted to a circuit board in a chassis, the communications system comprising:

a connector system including a connector tray including an upper cover and a lower cover, the connector tray defining a leading end and a trailing end that is opposite the leading end, a first connector mounted to the connector tray at the leading end and configured to mate with the electrical connector mounted to the circuit board, and an electrical connector assembly mounted to the connector tray at the trailing end and configured to electrically connect to the cable such that a terminal of the first connector is electrically connected to the cable, and an electromagnetic shield comprising a body that defines a first end portion and a second end portion that is opposite the first end portion, wherein the first end portion is configured to receive the leading end of the connector, the second end portion is configured to engage the circuit board, and the body at least partially shields the connector tray when the first connector is mated with the electrical connector that is mounted to the circuit board, wherein the electrical connector assembly comprises a pivotally supported first latch member at a first side and a pivotally supported second latch member at a second side that is at laterally opposed to the first side, the first and second latch members comprise transversely staggered, respective handles, and the electromagnetic shield comprises first and second pockets connected to the body at the first end and operable to respectively receive the first and second latch members.

2. A connector comprising:

a connector tray that defines a leading end and a trailing end opposite the leading end;

a connector assembly disposed at the trailing end of the connector tray;

a pivotally supported first latch member disposed at a first side of the connector assembly; and a pivotally supported second latch member disposed at a second side of the cable assembly that is laterally opposed to the first side, wherein the first and second latch members comprise transversely staggered, respective handles.

3. The communications system as recited in claim 1, wherein the electromagnetic shield comprises:

a shield portion that extends from the first end portion in a first direction to the second end portion, wherein the shield portion is configured to at least partially shield the connector assembly when the connector assembly is inserted via at the first end portion and translates along the first direction toward the second end portion until that the leading end of the connector assembly is proximate to the second end portion.

4. The communications system as recited in claim 1, wherein the first end portion of the electromagnetic shield is configured to receive the leading end of the connector tray such that the connector tray slides toward the second end portion until the first connector mates with the electrical connector mounted to the circuit board.

5. The communications system of claim 1, further comprising a cam retention pocket configured to receive a corresponding cam member of the connector assembly.

6. The communications system of claim 3, wherein the shield portion comprises an upper wall disposed between opposite side walls to provide about 270 degrees of shielding.

7. The communications system of claim 1, wherein the first end portion of the electromagnetic shield defines an aperture that is configured to receive the leading end of the connector assembly therethrough.

8. The electromagnetic shield of claim 3, wherein an inner surface of the shield portion comprises a guide member configured to engage a complementary track on an outside surface of the connector assembly.

9. The connector of claim 2, wherein the connector assembly is a cable connector assembly.

10. The connector of claim 2, wherein the handles are staggered such that when a pair of connector systems are mounted laterally side-by-side adjacent handles pivot outwards without interfering with each other.

11. The connector of claim 2, wherein a lower edge of the first handle is vertically above an upper edge of the second handle.

12. The connector of claim 2, wherein the first and second latch members comprise respective cam members, and wherein the first and second latch members are operable to pivot inwards causing the respective the respective cam members to pivot outwards.

13. The connector of claim 12, wherein the cam members are configured to be received in corresponding cam retention pockets of a magnetic shield.

14. The connector of claim 2, further comprising a mating portion mounted to the connector tray at the leading end.

15. The connector of claim 14, wherein the mating portion is an insert molded leadframe assembly.

16. The connector of claim 14, wherein the connector tray comprises a cover and wherein the cover comprises longitudinally elongated grooves to secure the mating portion.

17. The connector of claim 14, wherein the connector tray comprises a printed circuit board with a conductive trace that electrically connects the mating portion and the connector assembly.

18. The connector of claim 14 wherein a wire from the cable assembly is directly connected to the mating portion.

19. The connector of claim 2, wherein the connector tray comprising a cover and wherein the cover comprises a guidance member disposed on an outer surface of the cover, wherein the guidance member is configured to mate with a corresponding guidance member on an inner surface of an electromagnetic shield.

* * * * *

UNITED STATES PATENT AND TRADEMARK OFFICE

CERTIFICATE OF CORRECTION

PATENT NO. : 8,002,583 B2
APPLICATION NO. : 12/388097
DATED : August 23, 2011
INVENTOR(S) : Johannes Maria Blasius van Woensel It is certified that error appears in the above-identified patent and that said Letters Patent is hereby corrected as shown below:

COL. 10, line 58 [Claim 3], delete the word "via"; at line 60, delete the word "that"

COL. 12, line 2 [Claim 12], delete the second occurrence of "the respective"

Signed and Sealed this
Eighteenth Day of October, 2011

David J. Kappos

David J. Kappos
*Director of the United States Patent and Trademark Office*